US008135297B2

(12) United States Patent
Kobayashi

(10) Patent No.: US 8,135,297 B2
(45) Date of Patent: Mar. 13, 2012

(54) IMAGE FORMING APPARATUS

(75) Inventor: Masato Kobayashi, Joso (JP)

(73) Assignee: Canon Finetech Inc., Ibaraki (JP)

( * ) Notice: Subject to any disclaimer, the term of this patent is extended or adjusted under 35 U.S.C. 154(b) by 329 days.

(21) Appl. No.: 12/004,889

(22) Filed: Dec. 21, 2007

(65) Prior Publication Data

US 2008/0170872 A1 Jul. 17, 2008

(30) Foreign Application Priority Data

Dec. 23, 2006 (JP) ..... 2006-346827

(51) Int. Cl.
*G03G 15/20* (2006.01)

(52) U.S. Cl. ..... 399/69

(58) Field of Classification Search ..... 399/69, 399/97

See application file for complete search history.

(56) References Cited

U.S. PATENT DOCUMENTS 5,659,844 A * 8/1997 Fujiwara ..... 399/69
6,937,828 B2 * 8/2005 Hasegawa et al. ..... 399/69
7,065,309 B2 * 6/2006 Sato ..... 399/69
2001/0028803 A1 * 10/2001 Yoda ..... 399/44

FOREIGN PATENT DOCUMENTS

JP 09-101695 4/1997
JP 10-010915 1/1998

* cited by examiner

*Primary Examiner* — Constantine Hannaher
(74) *Attorney, Agent, or Firm* — Reed Smith LLP

(57) ABSTRACT

In order to simultaneously prevent both curl generation and fixation performance deterioration upon both-surface image formation of a recording medium P, a fixation temperature control means which subjects a transporting-direction trailing end region of a first surface (front surface) of the recording medium P to fixation at a low heating treatment temperature, thereby suppressing the curl generation amount in the region subjected to the low-temperature heating treatment, at the same time, subjects the region except for the region that has undergone the low-temperature heating treatment to fixation at a normal heating treatment temperature, thereby preventing deterioration in the fixation performance, and subjects the region which has undergone the low-temperature heating treatment to heating treatment of a high temperature upon fixation of a second surface (back surface), thereby preventing defective fixation in the low-temperature heating treatment region is provided.

2 Claims, 4 Drawing Sheets

(40°C/90%)

IMAGE FORMING APPARATUS

TECHNICAL FIELD

The present invention relates to an image forming apparatus in which toner images are sequentially formed on both front and back surfaces of a recording medium.

BACKGROUND ART

Conventionally, among various image forming apparatuses such as copy machines and laser beam printers, a both-surface image forming apparatus in which image formation is automatically performed on both surfaces, that is, a front surface and a back surface of a sheet-like recording medium composed of paper or the like is known. In such a both-surface image forming apparatus, first of all, in an image formation unit having an image supporter such as a photoconductive drum, a toner image is formed on a first surface (front surface) of a recording medium, and the toner image is subjected to first heating treatment by a fixing means so as to fix the image on the recording medium. Then, the recording medium on which the toner image is fixed on the first surface (front surface) thereof is sent to a both-surface transporting means and reversed upside-down by a switchback operation or the like. The reversed recording medium is fed again to the image formation unit, and a toner image is formed on a second surface (back surface) of the recording medium. The toner image is subjected to second heating treatment by the fixing means and fixed on the recording medium. In this manner, image formation on both the front and back surfaces of the recording medium is automatically performed.

However, when image formation is performed on both front and back surfaces of a recording medium in the above described manner, a curl (rolling tendency) is tend to be generated in the recording medium when first fixation heating treatment at a high temperature with respect to the first surface (front surface) of the recording medium is performed, and, due to the curl (rolling tendency), sometimes the recording medium winds around the image supporter such as a photoconductive drum and is not readily separated upon image formation with respect to the second surface (back surface) of the recording medium. More specifically, first of all, there is a tendency that the first surface (front surface), which is the heated side of the recording medium, largely thermally expands toward the second surface (back surface) due to the heating treatment upon fixation with respect to the toner on the first surface (front surface) of the recording medium; therefore, a curl having a shape in which the entirety of the recording medium after fixation is warped like a curvature toward the second surface (back surface) side is generated. Then, when the recording medium, which is curled toward the second surface (back surface) side, is fed again to the image formation unit and image formation is performed, the curl-generated part of the recording medium winds around the outer peripheral surface of the image supporter such as the photoconductive drum. As a result, there is a possibility that the recording medium, which normally exits the image formation unit while it is separated from the image supporter, cannot be transported, thereby leading to a jammed state.

With respect to such a problem of transporting failure due to generation of the curl upon image formation on both the front and back surfaces of the recording medium, conventionally, a countermeasure of uniformly lowering the heating treatment temperature (fixation temperature adjustment) upon fixation on the first surface (front surface) of the recording medium, thereby reducing the generation amount of curls has been sometimes employed. However, in this case, fixation performance across the entirety of the image formation region of the first surface (front surface) may be significantly deteriorated.

There is also a proposal in which the heating treatment temperature (fixation temperature adjustment) merely with respect to a trailing end region of the first surface (front surface) of the recording medium in the transporting direction is lowered, thereby suppressing the curl generation amount in the region of the second surface (back surface) that serves as a leading end in the transporting direction and preventing deterioration in the fixation performance in the entirety of the image formation region (for example, see Japanese Patent Application Laid-Open (kokai) No. 1998-10915). However, this proposal also has a problem that deterioration in the fixation performance with respect to the region in which the heating treatment temperature upon fixation is lowered, that is, the transporting-direction trailing end region of the first surface (front surface) cannot be prevented.

Therefore, it is an object of the present invention to provide an image forming apparatus capable of simultaneously preventing both defective transportation and defective fixation due to the curl generating phenomenon upon both-surface image formation of the recording medium.

SUMMARY OF THE INVENTION

In order to achieve the above described object, an image forming apparatus according to the present invention has a fixing means which performs first heating treatment with respect to a toner image formed on a front surface of a recording medium transported in a desired direction and then performs second heating treatment with respect to a toner image formed on a back surface of the recording medium; and a fixation temperature control means which arbitrarily controls first and second heating treatment temperatures of the fixing means; wherein the fixation temperature control means controls the heating treatment temperature with respect to a transporting-direction trailing end region of the recording medium to be lower than the other region in the first heating treatment and subjects the region at which the heating treatment temperature is lower in the first heating treatment to heating treatment at a heating treatment temperature higher than the other region in the second heating treatment.

According to the image forming apparatus according to the present invention having such a configuration, when the transporting-direction trailing end region of the first surface (front surface) of the recording medium is subjected to fixation at a low heating treatment temperature, the curl generation amount in the region subjected to the low-temperature heating treatment is suppressed, and, at the same time, since fixation is performed at a normal heating treatment temperature for the other region except for the region subjected to the low-temperature heating treatment, good fixation performance can be obtained. The region subjected to the low-temperature heating treatment in the first surface (front surface) is subjected to heating treatment at a high temperature upon fixation of the second surface (back surface); therefore, generation of defective fixation in the above described low-temperature heating treatment region is prevented. As a result, both the curl generation and fixation performance deterioration upon the both-surface image formation of the recording medium are prevented at the same time, both-surface image formation with respect to the recording medium can be performed significantly well, and the reliability of the image forming apparatus can be significantly improved at low cost.

Another aspect of the image forming apparatus according to the present invention can employ a configuration having a switchback means which reverses and transports a leading end and a trailing end in a transporting direction of the recording medium; wherein the fixation temperature control means controls the heating treatment temperature with respect to the transporting-direction leading end region of the recording medium to be higher than the other region in the second heating treatment.

According to the image forming apparatus according to the present invention having such a configuration, when the switchback means which reverses and transports the leading end and trailing end in the transporting direction of the recording medium is provided, the transporting-direction leading end region of the second surface is subjected to heating treatment at a low temperature upon heating treatment of fixation with respect to the first surface (front surface) of the recording medium, thereby suppressing curl generation, and the transporting-direction leading end region subjected to the low-temperature heating treatment is subjected to heating treatment at a high temperature upon heating treatment of fixation with respect to the second surface (back surface), thereby preventing deterioration in the fixation performance. Thus, both the curl generation and fixation performance deterioration upon both-surface image formation of the recording medium can be prevented at the same time.

Furthermore, another aspect of the image forming apparatus according to the present invention can employ a configuration in which the trailing end region of the recording medium in the first heating treatment in which the heating treatment temperature is controlled to be low by the fixation temperature control means and the leading end region of the recording medium in the second heating treatment are set in the regions which approximately match with each other in the recording medium.

According to the image forming apparatus according to the present invention having such a configuration, the region itself subjected to low-temperature heating treatment with respect to the first surface (front surface) of the recording medium is subjected to high-temperature heating treatment upon heating treatment of fixation with respect to the second surface (back surface).

Furthermore, another aspect of the image forming apparatus according to the present invention can employ a configuration in which the toner image on the recording medium is formed by transfer from an image supporter, and the recording medium onto which the toner image is transferred from the image supporter is configured to be separated from an outer peripheral surface of the image supporter by utilizing curvature of an outer peripheral surface of the image supporter. Also, another aspect of the image forming apparatus according to the present invention can employ a configuration in which the fixation temperature control means which controls the increase or decrease of the heating treatment temperature or displacement of the position at least in accordance with either one of a temperature and humidity of a usage environment.

According to the image forming apparatus according to the present invention having such a configuration, since the increase or decrease of the heating treatment temperature or displacement of the position thereof upon heating treatment of fixation is arbitrarily adjusted in accordance with the curl generation amount that varies depending on the temperature or humidity of the usage environment, always good image formation is performed regardless of the usage environment.

DESCRIPTION OF PREFERRED EMBODIMENT

Figure 1:
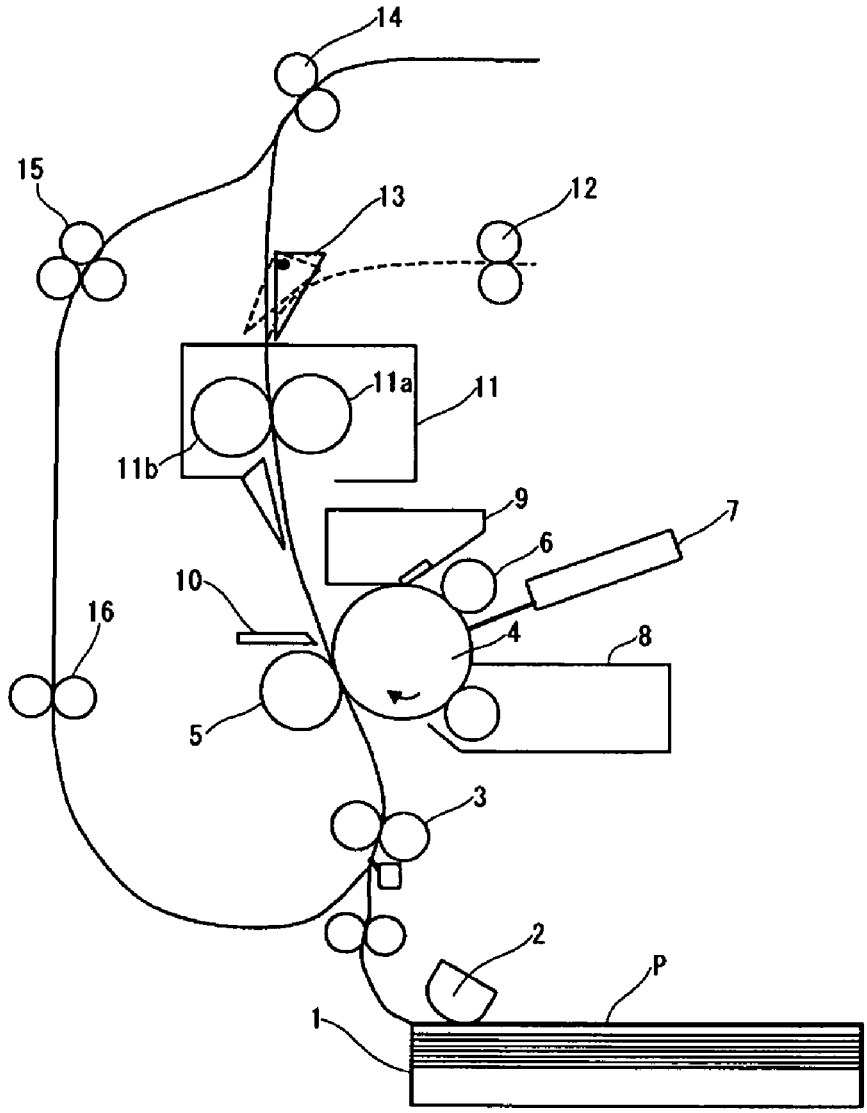
FIG. 1 is a schematic explanatory diagram showing a main part of a printer as an image forming apparatus to which the present invention is applied.

Hereinafter, an embodiment of the present invention will be described in detail based on drawings. First of all, an outline of an overall structure and working of an image forming apparatus having an automatic both-surface image formation mechanism (reversing means of a switchback method) shown in FIG. 1 will be described.

In a paper-feeding cassette 1 disposed at a lowest part of an apparatus main body, recording paper sheets P serving as sheet-like recording media are housed in a stack. Each of the recording paper sheets P is sequentially sent toward a paper-feeding-side transporting path by the rotation of a paper-feeding roller 2, then transported so as to abut a resist roller pair 3 disposed in the paper-feeding-side transporting path wherein the inclined state thereof is corrected, then transported at arbitrary timing into a transfer region which is a nip part where a cylindrical photoconductive drum 4 and a transfer roller 5 constituting an image formation unit are disposed to be opposed to each other, and then subjected first image formation (printing) therein with respect to a first surface (front surface) of the recording paper sheet P.

More specifically, the outer peripheral surface of the above described photoconductive drum 4 is uniformly electrically charged by an electrically charging device 6, and image writing is performed on the outer peripheral surface of the photoconductive drum 4 by an exposure device 7 after the uniform electrical charging, thereby forming an electrostatic latent image. The electrostatic latent image is subjected to development and visualization when toner is fed from a development device 8, and a toner image is formed. The toner image formed on the photoconductive drum 4 is transferred onto the recording paper sheet P by transfer bias applied to the above described transfer roller 5, and first image formation (printing) with respect to the first surface (front surface) of the recording paper sheet P is performed. Remaining toner that is not completely transferred onto the recording paper sheet P and remaining on the photoconductive drum 4 is removed from the photoconductive drum 4 by a cleaner 9.

Meanwhile, the recording paper sheet P onto which the toner image has been transferred is separated from the outer peripheral surface of the photoconductive drum 4 both by an electric field action of separation bias applied via a static charge eliminating separation needle 10 and a self-stripping action on the outer peripheral surface of the above described approximately-cylindrical photoconductive drum 4, and transporting is continued. The recording paper sheet P on which an unfixed toner image is thus supported on the first surface (front surface) thereof is transported to a nip part between a fixing film 11*a* and a pressurizing roller 11*b* provided in a fixation device 11 constituting a fixing means, and fixation treatment of the unfixed toner image is performed by heating treatment by the fixation device 11.

In a normal case (case of a one-surface image formation mode), the recording paper sheet P on which the toner image is fixed is discharged toward outside the apparatus as it is by a discharge roller pair 12. However, when a both-surface image formation mode is set, image formation (printing) with respect to the second surface (back surface) of the recording paper sheet P is performed. More specifically, in the downstream side of the fixation device 11, a swinging flapper 13 which changes the transporting path of the recording paper sheet P between the one-surface image formation mode and the both-surface image formation mode is disposed. When the swinging flapper 13 is switched to the position of the solid line of FIG. 1, the recording paper sheet P on which the toner image is fixed on the first surface (front surface) in the above described manner is transported toward a reversing roller pair 14 provided in an automatic both-surface transporting unit of a switchback reversing method.

The recording paper sheet P is once transported to the downstream side by rotary drive of the reversing roller pair 14, stopped before the trailing end part of the recording paper sheet P does not completely escapes therefrom, and subjected to reverse rotation. As a result, the trailing end of the recording paper sheet P until this point is reversed to a leading end, the paper sheet is caused to be in the state in which the front side and the back side thereof are reversed with respect to the above described image formation unit, and the sheet is again transported toward the paper-feeding side by a both-surface first transporting roller pair 15 and a both-surface second transporting roller pair 16.

Then, as well as the above described case of image formation with respect to the first surface (front surface), the recording paper sheet P is fed to the resist roller pair 3 and again transported to the image formation unit, and a toner image corresponding to the second surface (back surface) formed on the photoconductive drum 4 is transferred onto the second surface (back surface) of the recording paper sheet P by the transfer roller 5. The recording paper sheet P on which the toner image is transferred on the second surface (back surface) is transported to the fixation device 11 as well as the first surface (front surface), and the toner image on the second surface (back surface) is subjected to heating treatment therein and fixed. Then, when the swinging flapper 13 is switched to the position of a broken line in FIG. 1, the sheet is transported to a discharging side and discharged to outside the apparatus by the transporting action of the discharging roller pair 12.

When the both-surface image formation mode is set in this manner, image formation (printing) is performed respectively on both the front and back surfaces (first surface and second surface) of the recording paper sheet (recording medium) P, and heating treatment is sequentially executed twice in the above described fixation device 11 in order to perform fixation of the toner images formed on both the front and back surfaces of the recording paper sheet P. The heating treatment temperature in the second fixation with respect to both the front and back surfaces (first surface and second surface) of the recording paper sheet P in the fixation device 11 is configured to be suitably controlled by a fixation temperature control means (controller), which is not shown.

Figure 2:
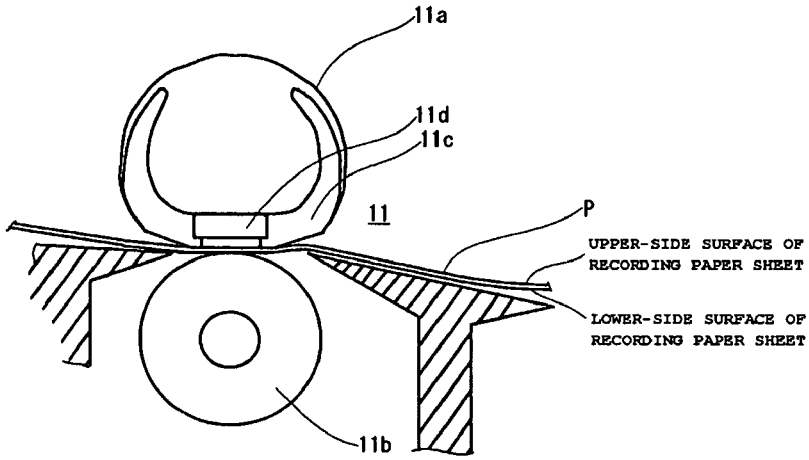
FIG. 2 is a vertical cross sectional explanatory diagram schematically showing a structure of a fixation device disposed in the printer shown in FIG. 1.

Before explaining the control operation by the fixation temperature control means, the structure of the above described fixation device 11 will be described. As shown in FIG. 2, in the fixation device 11, the fixing film (heating element) 11*a* constituting a part of a heating element is provided, and the pressurizing roller 11*b* is in contact with the back surface side in the drawing, of the fixing film 11*a* with a pressure by an arbitrary biasing means such as a spring, which is not shown. Then, the recording paper sheet (recording medium) P serving as a heating target element is caused to pass through a fixing nip region formed at the part of pressure contact between the fixing film 11*a* and the pressurizing roller 11*b*, and heating fixation treatment with respect to the unfixed toner image on the recording paper sheet P is performed by the heating/pressurizing action applied in the fixing nip region.

The fixing film 11*a* provided in the above described fixation device 11 is supported so as to be circularly slidable along the outer peripheral surface of a film guide 11*c* serving as a heating support member attached to a pressure stay having rigidity and heat resistance property. At a part of a sliding surface formed on the back surface side in the drawing, of the film guide 11*c*, a heating surface of a thin long plate-like ceramic heater 11*d* is attached so as to be exposed toward lower side. The ceramic heater 11*d* constitutes a heating element which applies heat necessary for fixing process to a fixing nip region formed in the pressure-contact part between the pressurizing roller 11*b* and the fixing film 11*a*; and, in the disposition relation, the inner peripheral surface of the fixing film 11*a* is slidably in close contact with the heating surface of the back surface in the drawing, of the ceramic heater 11*d*.

The fixing film 11*a* in the present embodiment is formed of a material having a small thermal capacity such as polyimide, polyamide, PEEK, PES, PPS, PFA, PTFE, or FEP having heat resistance and thermal plasticity. In order to ensure offset prevention and separative performance of the recording material, the surface layer of the fixing film 11*a* is covered by a mixture or any one of heat resistance resins having good detachability such as PFA, PTFE, and FEP. The film guide 11*c* serving as the heating support member is formed of, for example, liquid crystal polymer, phenol resin, PPS, or PEEK, has the ceramic heater 11*d* at a lower end part as described above, is composed as a heat insulating member which prevents heat dissipation to the direction opposite to the nip region, and has a shape and size so that the above described fixing film 11*a* can move in the transporting direction (direction from right to left in FIG. 2) of the recording paper sheet (recording medium) P with allowance.

Furthermore, as the above described ceramic heater 11*d*, a heater of a so-called tensionless type disclosed in, for example, Japanese Patent Application Laid-Open (kokai) No. 1992-44075 to 44083, Japanese Patent Application Laid-Open (kokai) No. 1992-204980 to 204984 is employed; wherein a heater substrate which is extended in a thin long shape along the longitudinal direction orthogonal to the transporting direction of the recording paper sheet P and has heat resistance, insulating property, and good thermal conductivity, and resistance heating bodies are disposed along the longitudinal direction (image formation width direction) of the heater substrate. The ceramic heater 11*d* is heated when power for heating is fed from power-feeding electrodes (not shown in the drawing) disposed at both-end portions of the longitudinal direction of the resistance heating bodies. The heating temperature in this process is detected by a thermistor (thermometry device) disposed at a part immediately above the heater substrate.

Meanwhile, in a roller employed as the above described pressurizing roller 11*b*, in the outer peripheral side of a core bar composed of a metal member of aluminum or the like, a primer layer is formed via an elastic layer formed of heat-resisting rubber such as silicon rubber or fluorine rubber or foam or the like of silicon rubber, and, in the surface layer thereof, a detachment layer formed of a tube of PFA, PTFE, FEP, or the like is formed. The above described primer layer is formed to have electrical conductivity and is composed so that the surface thereof is negatively electrically charged through friction when highly resistive paper such as dry paper passes through; thus, toner repels the friction electrical charge, thereby preventing generation of electrostatic offset in which the toner adheres the fixing film 11*a* side again.

Such pressurizing roller 11*b* is configured to be rotated and driven by a drive means including an arbitrary fixation motor driven and controlled by a fixation drive control means (controller), of which illustration is omitted. The roller is also configured so that the fixing film 11*a* is moved while it is circularly slid following the rotary drive of the pressurizing roller 11*b*, and the recording paper sheet (recording medium) P introduced into the fixation nip region is transported (moved) while the sheet is pressed in the state in which it is in close contact with the fixing film 11*a*. When the recording sheet P is transported in the fixation nip region in this manner, an unfixed toner image supported on the recording paper sheet P is subjected to a fixation process by the heat from the above described ceramic heater 11*d* and a nip pressure by the pressurizing roller 11*b*.

Since the fixing film 11*a* performs rotary movement while sliding on the heating surface of the ceramic heater 11*d* disposed in the inner side thereof and the sliding surface of the film guide (heating support body) 11*c* as described above, the friction resistance between the heating surface of the ceramic heater 11*d* and the sliding surface of the film guide 11*c* and the inner peripheral surface of the fixing film 11*a* has to be suppressed to be small. Therefore, at the part where the fixing film 11*a* is in close contact with the heating surface of the ceramic heater 11*d* and the sliding surface of the film guide 11*c*, a small amount of a lubricant agent such as heat resistive grease for maintaining good following drive performance and sliding performance of the fixing film 11*a* is interposed, thereby enabling smooth rotary movement of the fixing film 11*a*.

The power distribution control with respect to the ceramic heater 11*d* of the fixation device 11 having such a structure is configured to be suitably controlled by the above described fixation temperature control means (controller) so that the heating treatment temperature upon fixation with respect to an unfixed toner image on the recording paper sheet P is appropriately adjusted. This is for the reason that the curl amount generated in the transporting-direction trailing end of the recording paper sheet P by the heating treatment upon fixation depends on the heating temperature of the ceramic heater 11*d* serving as a heating source with respect to the recording paper sheet P, and an embodiment of the temperature control (temperature adjustment control) by the fixation temperature control means will be described hereinafter.

Figure 3:
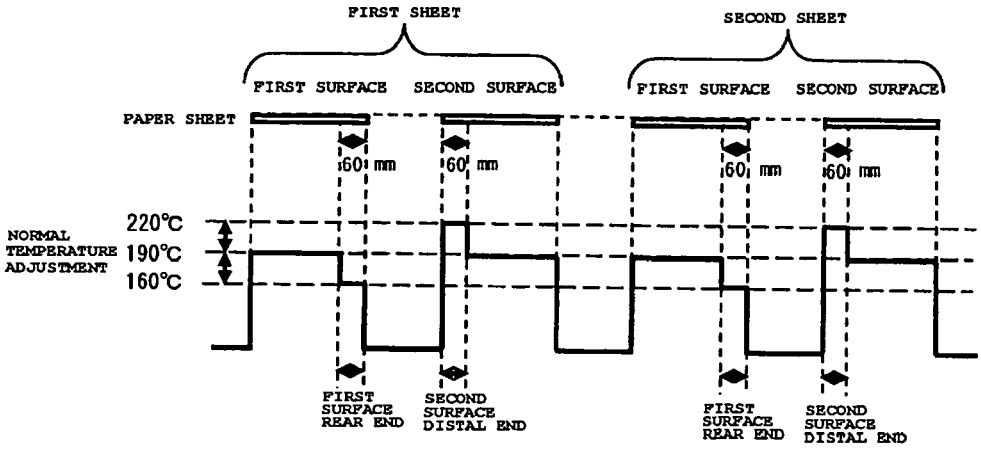
FIG. 3 is a timing diagram showing a heating temperature control (fixation temperature adjustment) sequence with respect to the fixation device by a fixation temperature control means in an embodiment of the present invention.

The temperature control (temperature adjustment) by the fixation temperature control means is executed, for example, in the manner shown in FIG. 3. More specifically, it is configured so that, first of all, upon heating treatment with respect to the front surface which is the first surface of a first recording paper sheet P sent into the above described fixation device 11, temperature control (temperature adjustment) by the fixation temperature control means is executed; then, temperature control is similarly executed upon heating treatment with respect to the back surface which is the second surface of the first recording paper sheet P. Similar temperature control is repeated with respect to second and third recording paper sheets P.

More specifically, in the temperature control (temperature adjustment) of the first surface (front surface) of the recording paper sheet P sent into the above described fixation device 11, control of reducing the heating treatment temperature (temperature adjustment temperature) with respect to the transporting-direction trailing end region (region having a width of about 60 mm from trailing edge) of the recording paper sheet P to a temperature (160° C.) lower than a normal heating treatment temperature (190° C.) with respect to the other region is performed, thereby executing first heating treatment by a low temperature. On the other hand, in next control of the heating treatment temperature (temperature adjustment temperature) with respect to the second surface (back surface) of the recording paper sheet P, with respect to the transporting-direction leading end region (region having a width of about 60 mm from leading edge) of the recording paper sheet P, that is, the region corresponding to the previous low-temperature heating region of the first surface (front surface), the temperature is controlled to a heating treatment temperature (220° C.) higher than the normal heating treatment temperature (190° C.) so as to compensate for the deficient amount of the temperature in the above described low-temperature heating treatment, and second heating treatment by a high temperature is executed.

As described above, in the present embodiment, the fixation temperature control means sets so that the transporting-direction trailing end region of the recording paper sheet P where the heating treatment temperature is controlled to be low upon the first fixation and the transporting-direction leading end region of the recording paper sheet P where the heating treatment temperature upon next second fixation is controlled to be high are the regions that correspond to each other.

Figure 4:
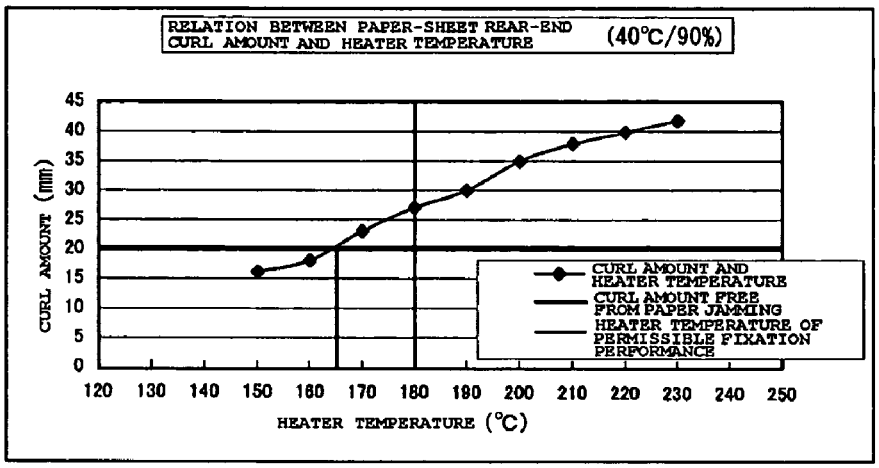
FIG. 4 is a line diagram showing the relation between the trailing end curl amount generated under a particular environment upon fixation of the first surface (front surface) of the recording paper sheet in both-surface image formation and heater temperature.

FIG. 4 shows an example of the relation between the heater temperatures (horizontal axis) and the trailing end curl amounts (vertical axis) generated in the transporting-direction trailing end of the first surface (front surface) of the recording paper sheet P under a usage environment of a temperature of 40° C. and humidity of 90%. Herein, it has been found out that paper jamming due to the second surface (back surface) of the recording paper sheet P winding around the drum can be prevented, for example, when the trailing end curl amount is suppressed to an amount smaller than 20 mm upon fixation of the first surface (front surface) of the recording paper sheet P; and, in order to suppress the trailing end curl amount smaller than 20 mm, the heating treatment temperature (temperature adjustment temperature) has to be set, for example, less than 165° C. However, a heating temperature of 180° C. or more is needed for reliably fixing a toner image on the recording paper sheet P, and, at least, a heating treatment temperature of 160° C. is needed for performing temporal fixation of the degree that the toner does not fall even when the toner image fixed on the recording paper sheet P is slightly rubbed.

Therefore, when fixation is performed at a heating treatment temperature of 160° C. across the entire region of the recording paper sheet P, the curl generation amount is suppressed to a good level; however, on the other hand, the fixation performance is deteriorated across the entire region of the recording paper sheet P, and a temporal fixation state is obtained. Therefore, in the present embodiment, the region relating to the paper jamming due to above described drum winding of the second surface (back surface) of the recording paper sheet P, that is, the region having a width about 60 mm from the transporting-direction trailing edge of the recording paper sheet P, the heating treatment temperature is controlled to 160° C., which is lower than the normal heating treatment temperature of 190° C. by about 30° C., thereby suppressing generation of the trailing end curl. Meanwhile, with respect to the other region from the transporting-direction leading edge to the region having a width of about 60 mm, the heating treatment temperature is controlled to be 190° C., which is a normal heating treatment temperature, thereby ensuring sufficient fixation performance.

By virtue of the above described control operation of the fixation temperature control means, the curl amount generated in the transporting-direction trailing end region of the first surface (front surface) of the recording paper sheet P is reduced; however, the fixation performance in the region is at a level of temporal fixation. Therefore, upon fixation with respect to the toner image on the second surface (back surface) of the recording paper sheet P after the switchback reversing operation, the fixation heating treatment temperature with respect to the leading end region (region having a width of about 60 mm from leading edge) of the second surface (back surface) which is the above described trailing end region in the first surface (front surface) is increased by 30° C. than the normal heating treatment temperature corresponding to the amount that the temperature is lowered by 30° C. in the first surface (front surface) as described above and controlled to a heating treatment temperature of about 220° C., thereby ensuring sufficient fixation performance.

As described above, in the present embodiment, fixation is performed at a low heating treatment temperature merely with respect to the transporting-direction trailing end in the first surface (front surface) of the recording paper sheet P, thereby suppressing the curl generation amount in the trailing end region which has undergone the low-temperature heating treatment and preventing deterioration in the fixation performance in the entire image formation region except for the transporting-direction trailing end region which has undergone the low-temperature heating treatment. Then, as described above, with respect to the transporting-direction trailing end region which has undergone the low-temperature heating treatment, that is, the leading end region of the second surface (back surface) of the recording paper sheet P after it has undergone the switchback reversing operation, fixation at a higher heating treatment temperature is performed; therefore, generation of deficient fixation in the leading end region of the second surface (back surface) is prevented, and, as a result, both the curl generation and fixation performance deterioration in both-surface image formation of a recording medium can be prevented at the same time.

Figure 5:
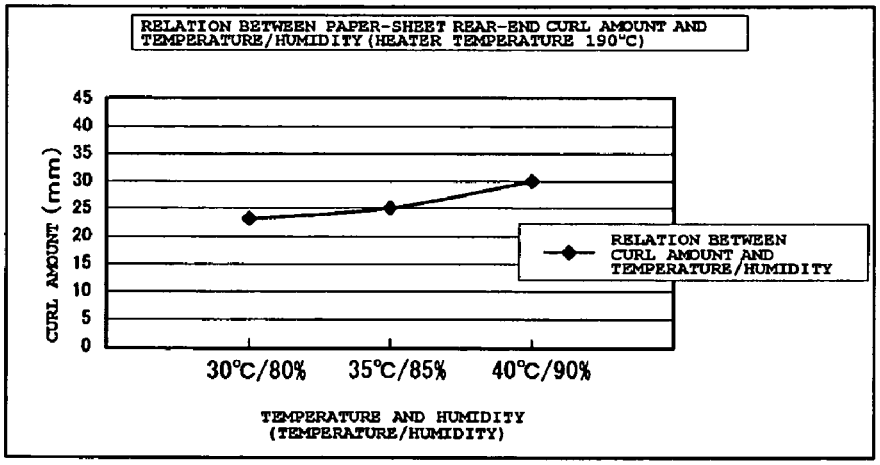
FIG. 5 is a line diagram showing the relation between a trailing end curl amount generated upon fixation of the first surface (front surface) of the recording paper sheet in both-surface image formation and the environment temperature and humidity.

Meanwhile, the curl generation amount of the recording paper sheet P has a tendency that it is increased in a high-temperature/high-humidity environment for example as shown in FIG. 5; therefore, the above described temperature control (temperature adjustment control) by the fixation temperature control means is particularly required in a high-temperature/high-humidity environment. Therefore, a second embodiment of the present invention has a configuration in which a means of detecting a usage environment is provided, for example, the degree of high-temperature/high-humidity is detected from the result of optimal transfer bias control (ATVC control) in each environment, and the lowered amount and lowered position of the heating treatment temperature with respect to the transporting-direction trailing end region of the first surface (front surface) of the recording paper sheet P and the increased amount and increased position of the heating treatment temperature with respect to the transporting-direction leading end region of the second surface (back surface) of the recording paper sheet P are varied in accordance with the usage environment.

In the above described ATVC control which is transfer bias control, a constant current 5 μA is caused to flow through an ion conductive transfer roller in which the electric resistance value is changed depending on the environment upon forward multi-rotation or forward rotation, and the voltage in this process is read so as to detect the environment. When a constant current of 5 μA is caused to flow under a high-temperature/high-humidity environment, for example, a voltage of 250 V is detected from the transfer roller, a voltage of 500 V is detected under a normal-temperature/normal-humidity environment, and a voltage of 1000 V is detected under a low-temperature/low-humidity environment. Thus, the relation of the voltage under each environment with respect to the constant current 5 μA is determined by the electric property of the transfer roller, and the usage environment can be detected by that.

Figure 6:
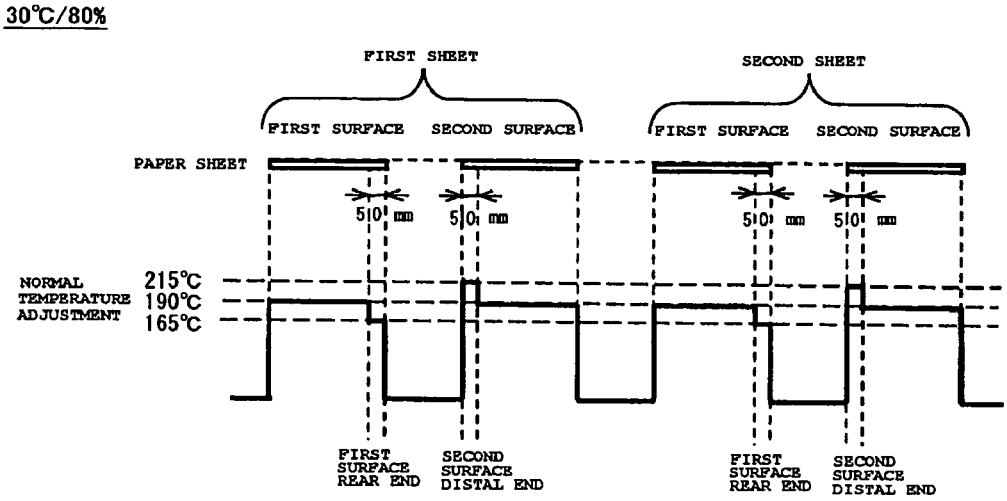
FIG. 6 is a timing diagram showing a heating temperature control (fixation temperature adjustment) sequence under a particular usage environment by a fixation temperature control means in another embodiment of the present invention.
Figure 7:
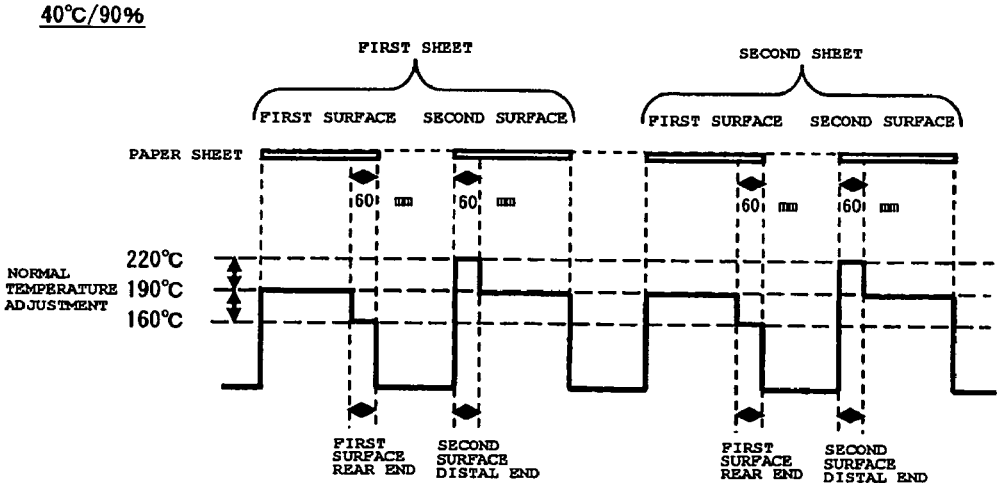
FIG. 7 is a timing diagram showing a heating temperature control (fixation temperature adjustment) sequence under another usage environment by the fixation temperature control means in the other embodiment of the present invention shown in FIG. 6.

Therefore, for example as shown in FIG. 6, when a temperature of 30° C. and humidity of 80% are detected by the above described environment detection, the reduced degree of the heating treatment temperature with respect to the transporting-direction trailing end region of the starting first surface (front surface) of the recording paper sheet P is set to be −25° C., the increased degree of the heating treatment temperature with respect to the transporting-direction leading end region of the next second surface (back surface) is set as +25° C., the starting position from which the heating treatment temperature with respect to the transporting-direction trailing end region of the first surface (front surface) of the starting first surface (front surface) of the recording paper sheet P is lowered is controlled to be 50 mm from the trailing edge, and the heating treatment temperature is controlled to be increased until the position 50 mm from the leading edge with respect to the transporting-direction leading end region of the next second surface (back surface).

Meanwhile, when temperature of 40° C. and humidity of 90% are detected by the above described environment detection, the lowered degree of the heating treatment temperature with respect to the transporting-direction trailing end region of the starting first surface (front surface) of the recording paper sheet P is set as −35° C., the increased degree of the heating treatment temperature with respect to the transporting-direction leading end region of the next second surface (back surface) is set as +35° C., the starting position from which the heating treatment temperature with respect to the transporting-direction trailing end region of the starting first surface (front surface) of the recording paper sheet P is lowered is controlled to be 60 mm from the trailing edge, and the heating treatment temperature is controlled to be increased with respect to the transporting-direction leading end region of the next second surface (back surface) until the position that is 60 mm from the leading edge.

In this manner, the fixation temperature control means in the second embodiment is configured to control the increase/reduction of the heating treatment temperature or displacement of the heating position upon fixation in accordance with at least either one of the temperature and humidity of the usage environment; therefore, always good image formation is performed regardless of the usage environment since the increase/decrease of the heating treatment temperature or the displacement of the heating position is arbitrarily adjusted in accordance with the temperature or humidity of the usage environment which is the case of increase/decrease in the curl generation amount.

Hereinabove, the embodiments of the invention accomplished by the present inventor have been described in detail; however, the present invention is not limited to the above described embodiments, and it goes without saying that various modifications can be made without departing from the spirit thereof.

For example, although the present invention is applied to a printer in the above described embodiments, the present invention can be widely applied to image forming apparatuses which perform various both-surface image formation such as a printer, copy machine, fax machine, and the like.

The invention claimed is:

1. An image forming apparatus comprising:

an image forming device for performing image formation with respect to front and back surfaces of a recording medium;

a fixation device which includes a heater heated with feeding electric power, a fixing film having an inner peripheral surface slidably in contact with the heater, and a pressurizing roller, the fixing film and the pressurizing roller forming a fixing nip at a pressure-contact part between the fixing film and the pressurizing roller, wherein the fixation device is configured to fix an image on the recording medium when passing through the fixing nip, perform a first heating treatment with respect to a toner image formed on the front surface of the recording medium transported in a desired direction and then perform a second heating treatment with respect to a toner image formed on the back surface of the recording medium transported in the desired direction;

a switchback reversing device which reverses a transporting direction of the recording medium following the completion of performing the first heating treatment with respect to the toner image on the front surface of the recording medium; and a fixation temperature control device which controls the fixation temperature upon the first and second heating treatments by the fixation device;

wherein the image forming apparatus is configured such that subsequent to forming the toner image on the front surface of the recording medium by the image forming device, the toner image is fixed with the first heating treatment by the fixation device, and the transportation direction of the recording medium is revered into the desired direction with the reversing device, and following the completion of forming the toner image on the back surface of the recording medium, the toner image is fixed with the second heating treatment by the fixation device, wherein the switchback reversing device is configured to reverse the recording medium so as to change a trailing end region in the desired direction of the recording medium during the first heating treatment into a leading end region in the desired direction during the second heating treatment, wherein the fixation temperature control device is configured to set the fixation temperature upon the first heating treatment by the fixation device into:

(a) a predetermined reference temperature with respect to the other region from the trailing end region having a predetermined width from the trailing edge of the recording medium; and (b) a first temperature being lower than the predetermined reference temperature with respect to the trailing end region of the recording medium; and wherein the fixation temperature control device is further configured to set the fixation temperature upon the second heating treatment by the fixation device into a second temperature with respect to the leading end region having the predetermined width from the leading edge of the recording medium, so that the fixation temperature with respect to the leading end region becomes higher than the reference temperature and that of the other region from the leading end region.

2. An image forming apparatus according to claim 1, wherein the fixation device is further configured to set the second temperature in response to the difference between the first temperature and the reference temperature.

* * * * *